US005356119A

United States Patent [19]

Schock

[11] Patent Number: 5,356,119

[45] Date of Patent: Oct. 18, 1994

[54] VERSATILE BABY BARRIER SYSTEM

[76] Inventor: Joel F. Schock, 4008 Copperfield Ct., Fargo, N. Dak. 58104

[21] Appl. No.: 993,406

[22] Filed: Dec. 21, 1992

[51] Int. Cl.[5] ..... E04H 17/16

[52] U.S. Cl. ..... 256/26; 256/27; 256/31; 49/463; 160/135

[58] Field of Search ..... 49/131, 463, 57; 160/135; 256/31, 27, 26, 25, 24

[56] References Cited

U.S. PATENT DOCUMENTS

| | | | |
|---|---|---|---|
| 135,837 | 2/1873 | Overholser | 160/135 |
| 2,629,110 | 2/1953 | Fournier | 256/25 X |
| 2,826,393 | 3/1958 | Miller | 256/31 X |
| 3,627,272 | 12/1971 | Friedberg | 256/25 |
| 4,143,698 | 3/1979 | Smolka | 160/135 X |
| 4,296,573 | 10/1981 | Wilson et al. | 256/26 X |
| 4,371,148 | 2/1983 | Harden | 160/135 X |
| 4,444,240 | 3/1984 | Bannister | 160/135 |
| 4,774,792 | 10/1988 | Ballance | 160/135 X |

FOREIGN PATENT DOCUMENTS

| | | | |
|---|---|---|---|
| 1078295 | 11/1954 | France | 160/135 |
| 67750 | 4/1951 | Netherlands | 256/24 |
| 1664209 | 7/1991 | U.S.S.R. | 256/24 |
| 679297 | 9/1952 | United Kingdom | 256/26 |

*Primary Examiner*—Randolph A. Reese
*Assistant Examiner*—Christopher J. Novosad
*Attorney, Agent, or Firm*—David A. Lingbeck

[57] ABSTRACT

A free standing versatile baby barrier system comprising individual modules each having a flat stiff mat-like horizontal component and a flat vertical component of similar width attached at one end near a mid-section of the horizontal component such that the width of the vertical component spans the width of the horizontal component. The vertical component is of sufficient height to prevent the baby from climbing over the barrier to the protected side, and the horizontal component is of sufficient length to require the baby to stand or crawl on the horizontal component thus securing the horizontal component to the floor by the baby's own weight. Individual modules may be detachably linked together with hinge members attached to the lateral edges of the vertical components of the modules, allowing for rotation of the modules relative to one another to conveniently adjust the barrier system.

2 Claims, 4 Drawing Sheets

VERSATILE BABY BARRIER SYSTEM

BACKGROUND OF THE INVENTION

1. Field of the Invention

The present invention relates to a device which will aid in the care of infants and small toddlers by providing a barrier to the movement of the child. More specifically, the present invention would act as a child barrier device in a highly versatile manner.

2. Prior Art

To those who care for infants and toddlers it is well known that they frequently roam and explore their environment. Although it is important for them to have ample room to roam and explore, they can get themselves into situations that may be a danger to themselves or be destructive to property on the premises without constant supervision by a responsible adult. Because adults often need help in restricting children from getting into such situations so that the adult can tend to other chores as well, a number of devices to aid them have been invented.

The most well known devices for restricting a small child's movements are known as playpens. Many variations in design of the playpen and crib have been described in the past including U.S. Pat. Nos. 3,680,155; 4,692,953; 4,750,223; 4,765,004; 4,819,285; 3,080,573; 3,430,271; and 5,076,546. All of these devices however, enclose the child and restrict them to a very small area to play in. Children find this degree of restriction frustrating and learn early to protest being placed in such a device.

Other devices for limiting a child's area of movement include a variety of child gates and barriers that are supported at both ends by a wall, baluster, door frame or combination therof, either by wedging, clamping, the use of screws or other mechanical means of fixation. These devices are limited in application to areas where they can span between the two points of fixation such as a hallway or stairway. One more novel approach in this area is the free standing gate described in U.S. Pat. No. 4,984,619 which does not need the mechanical support of a wall or baluster. The application of this device is limited to use at the top of a stairway only.

Another attempt at providing a barrier to a child's movement is the modular barrier described in U.S. Pat. No. 5,076,546. This device is more versatile than a playpen in that it is more portable and can make use of existing walls. The device has a limited number of combinations of corners and sides that can be used which will limit the situations in which it may be used. Also, it depends on friction between the device and the floor generated by its own weight to prevent a baby or toddler of sufficient strength from moving the device.

There are often only a few areas of a room or household in which it is undesirable to have the child. The shape of a barrier needed to protect those areas and the availability of walls or other objects on to which a barrier can be fixed is highly variable from one application to the next. What is is needed then, is a device versatile in its ability to protect these areas while leaving the rest of the area free for the child to play in. This device also needs to have a means of preventing an infant or toddler from being able to push or slide the device in a way that may enable them to get around it.

SUMMARY OF THE INVENTION

It is therefore the object of the present invention to provide a barrier to a child's movements only to those areas where it is undesirable to have the child while allowing freedom to roam the rest of the area in which the child is placed. This is accomplished by providing a system that is highly versatile, due to a free standing nature, an ability to be highly variable in length, and an ability to be set up with a variable number of corners of variable angles. It is also an object of this invention to be easily stored by an ability to be disassembled and folded flat.

This invention consists of modular units each made of a rigid, flat, mat-like horizontal component intended to lie flat on the floor. Attached to the approximate midsection of the horizontal component by one end, is a vertical component of similar width also made of a rigid flat material and of sufficient height so as to prevent a child from getting over the barrier. A number of means of attachment and bracing could be used to maintain a rigid perpendicular angle between the components yet allow for disassembly and folding for storage. The horizontal component is of sufficient length that the child must crawl or step on it to reach the vertical component thus using the child's own weight to anchor the system to the floor and extends out from each side of the vertical component sufficiently to prevent toppling of the system by pushing or pulling on the vertical component.

These modular units are linked to each other by a series of detachable hinge members allowing for rotation around the vertical axis from zero to ninty degrees between adjacent units, overlapping the horizontal components on the acute side of the created angle. A large variability in lengths of the system is accomplished by joining a variable number of modular units of varied width. The invention may also use small rubber pegs on the bottom of the horizontal component in order to increase friction on a floor surface. The invention may make use of a corner modular unit that would create a 270° angle on the baby side of the barrier without exposing significant amounts of the floor surface on that side of the barrier.

DETAILED DESCRIPTION OF THE INVENTION

Figure 1:
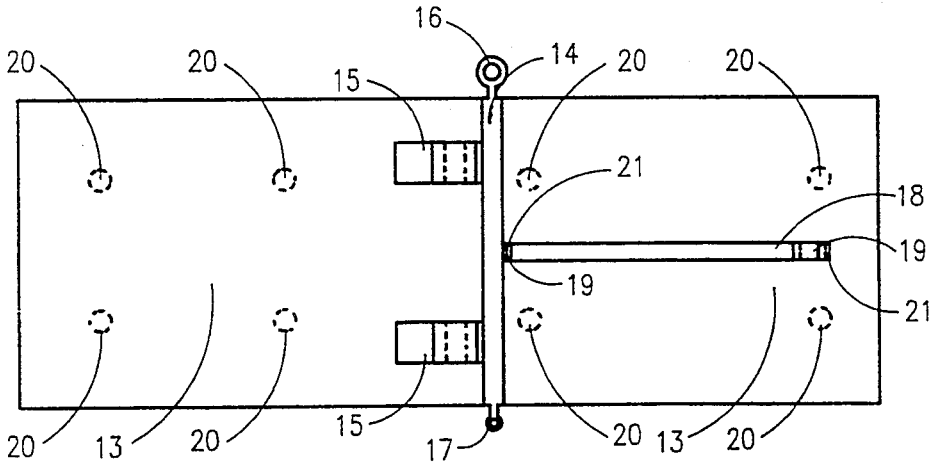
FIG. 1 is a top view of the preferred embodiment of a modular unit of the present barrier system.
Figure 2:
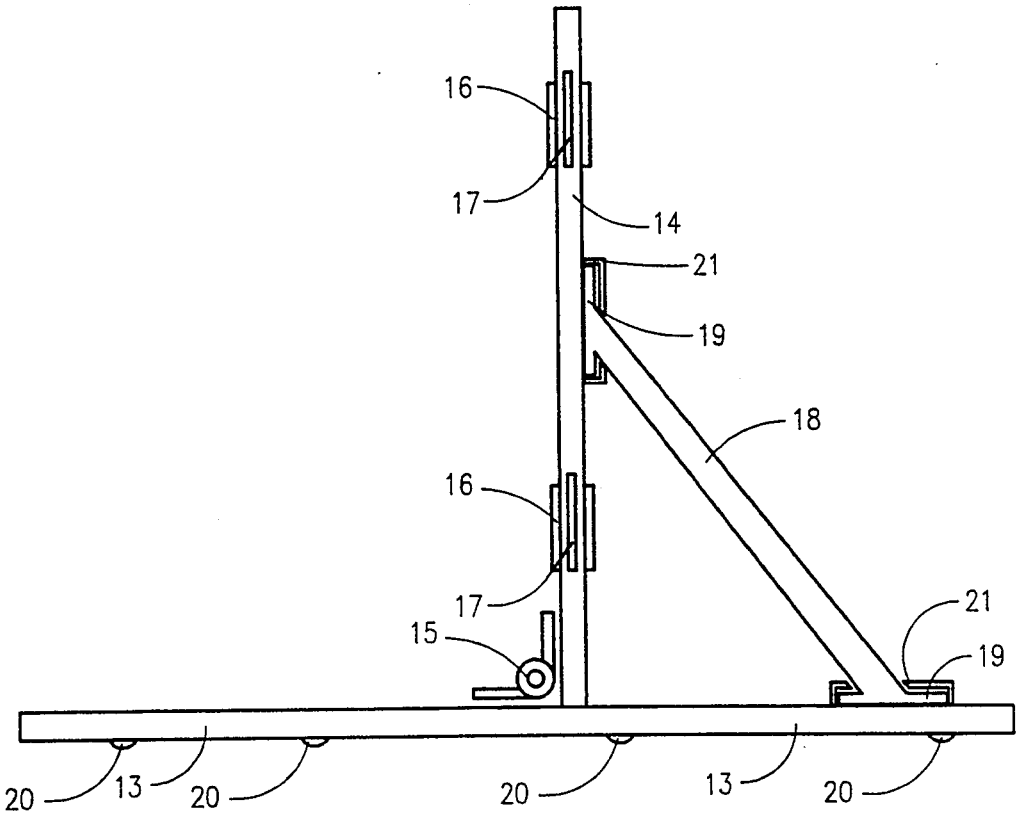
FIG. 2 is a side view of the preferred embodiment of a modular unit of the present barrier system.

Referring to FIGS. 1 and 2, a single modular unit of the barrier system is shown in which a horizontal component 13 of a flat, mat-like shape and constructed of a stiff boardlike material lies flat on the floor or ground, creating a base for each module. Attached perpendicular to the horizontal component 13 is a flat vertical component 14 of similar width and material as the horizontal component 13. This attachment is at the approximate mid-section of the horizontal component 13, makes the bottom edge of the vertical component 14 span the width of the horizontal component 13, and is accomplished by a set of hinges 15 which allows the vertical component 14 to be folded down on the horizontal component 13 such that the horizontal component 13 and vertical component 14 are parallel and flat for easy storage.

Figure 5:
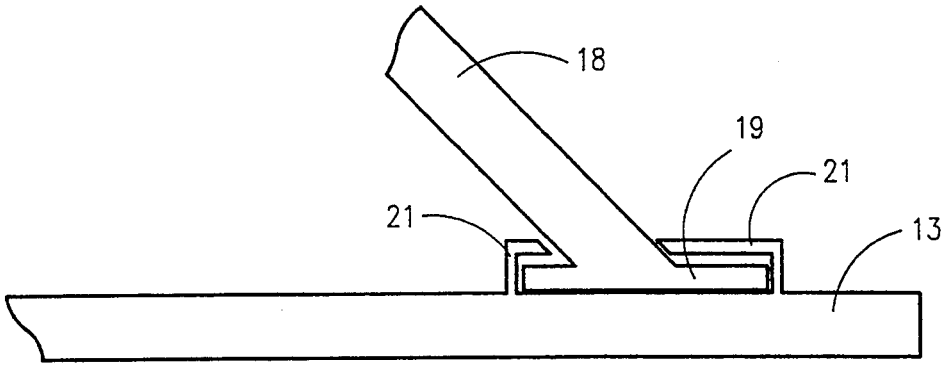
FIG. 5 is an enlarged fragmentary side view of the attachment system used to link the diagonal brace to both the vertical and horizontal components of each module.

The vertical component 14 is of sufficient height as to keep a baby from crawling, climbing or jumping over from the baby side of the barrier system to the protected side. When set up for use, the vertical component 14 is held perpendicular to the horizontal component 13 by a rigid, elongated diagonal brace 18 removably attached between the top protected side of the horizontal component 13 and the protected side of the vertical component 14. The points of attachment of the diagonal brace 18 to the horizontal component 13 and vertical component 14 are constructed by using a flange 19 fixidly attached to each end of the diagonal brace 18 which slides horizontally into complimentary slotted mounds 21 arising from and integral with the top protected side of the horizontal component 13 and protected side of the vertical component 14 as depicted in FIG. 5. The flange 19 fits into the slotted mound 21 in a relatively snug manner as to allow little movement between these components.

The horizontal component 13 extends from the vertical component 14 towards the baby side of the barrier a sufficient length such that a baby trying to reach the vertical component 14 must crawl or stand on the horizontal component 13 thus fixing the barrier to the floor with the baby's own weight. The horizontal component 13 also extends toward the protected side of the vertical component 14 by a sufficient length so as to keep the baby from being able to topple the barrier over toward the protected side of the barrier by leaning on the top of the vertical component 14.

The described system may make use of small pegs 20 on the bottom of the horizontal component 13 of varying number, material and arrangement in order to increase resistance to sliding of the barrier system with respect to the surface it rests on.

Figure 3:
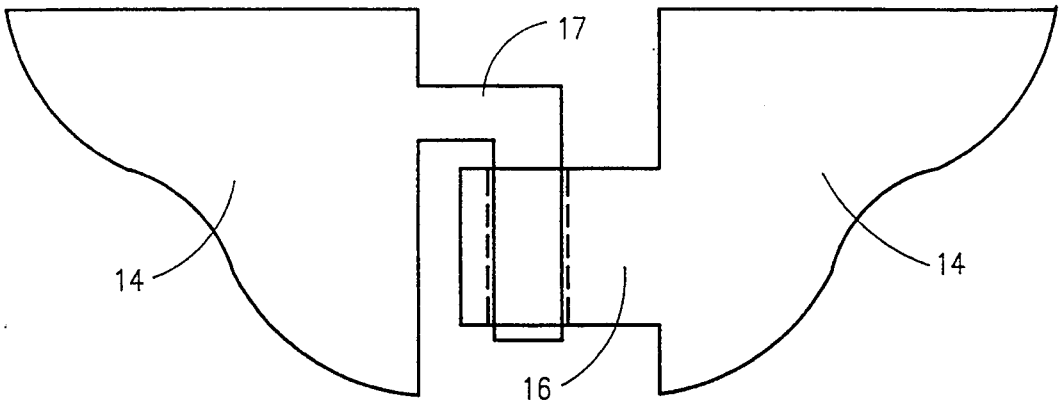
FIG. 3 is a frontal enlarged fragmentary view of the vertical hinge system for linking of the vertical components of the individual modular units.
Figure 4:
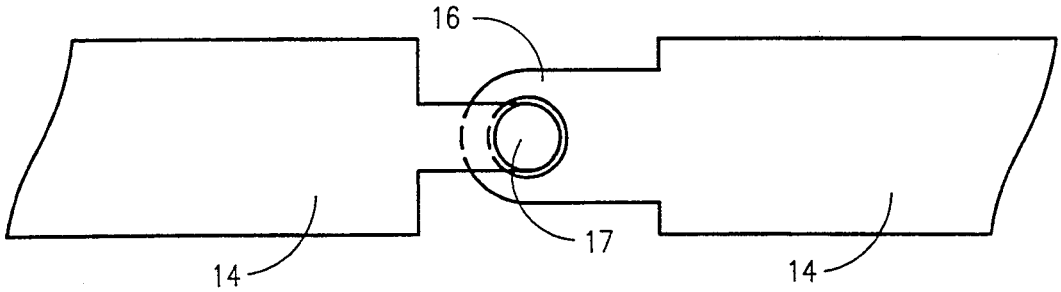
FIG. 4 is a top enlarged fragmentary view of the detachable vertical hinge system for linkage of the vertical components of the individual modular units.
Figure 6:
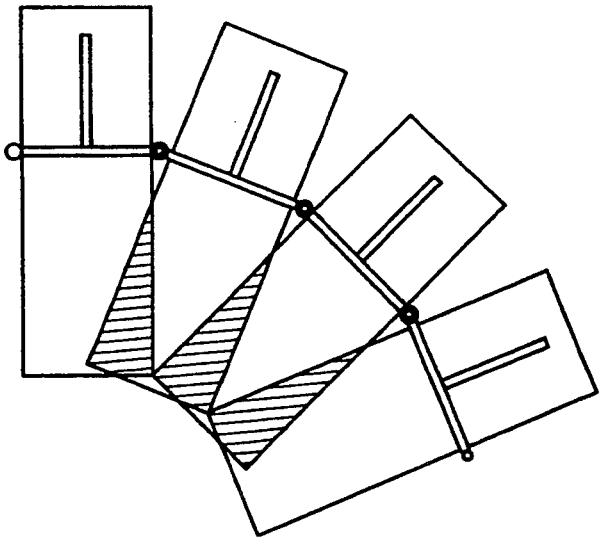
FIG. 6 is a top view showing the present invention in which several modules are linked together in one possible arrangement.
Figure 7:
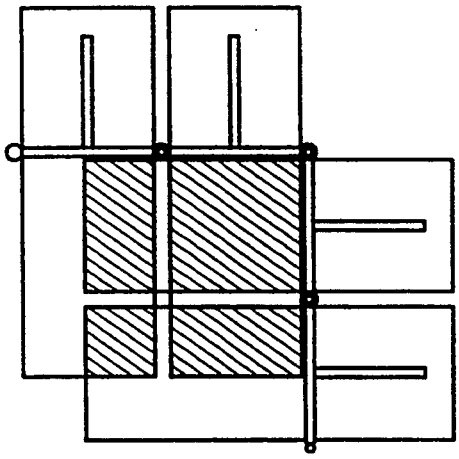
FIG. 7 is a top view showing the present invention in which several modules are linked together in one possible arrangement to form a right angle corner in the barrier system.
Figure 8:
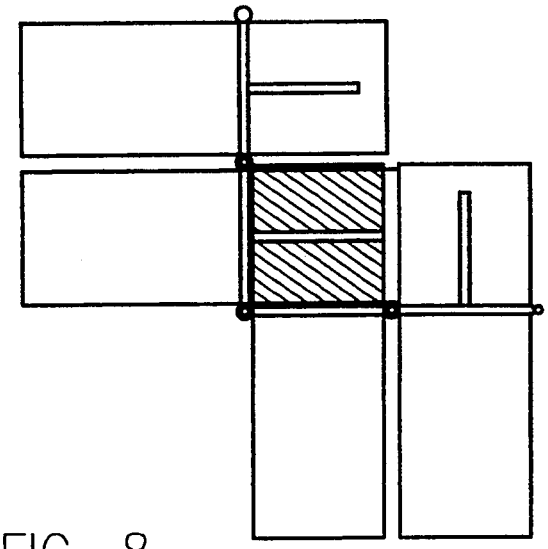
FIG. 8 is a top view showing the present invention in which several modules are linked together in one possible arrangement to form a right angle corner opposite of that in FIG. 7.

FIGS. 3 and 4 depict in detail hinges used on the lateral edges of the vertical component 14 of each module of the barrier system as seen in FIGS. 1 and 2. These hinges consist of a male member 17 and a female member 16. A number of male members 17 are fixidly attached to the same lateral edge of the vertical components 14 of each module. At similar heights as the male members 17 are corresponding female members 16 fixedly attached to the opposite edge of the vertical components 14 of each module. By inserting the male members 17 of one module into the corresponding female members 16 of an adjacent module, an indefinite number of modules may be linked together to form a barrier system of any desired length. The hinges described in FIGS. 3 and 4 would also allow for rotation around the vertical axis of one module with respect to an adjacent module thus allowing for the formation of a barrier system with a variety of curves and angles. Examples of several possible arrangements are depicted in FIGS. 6, 7 and 8 from a top view. When one module is rotated to any significant degree with respect to an adjacent module it is apparent that the horizontal components 13 must overlap on either the baby side or the protected side of the barrier system. Overlapping would occur as depicted in FIGS. 6, 7 and 8 by the shaded areas, but would vary with other alternative applications. In order for overlapping to occur, one module must be elevated with respect to it's adjacent module to approximately the height of the horizontal component 13 plus the height of any attached pegs 20. There also must be additional elevation equal to the height of the slotted mound 21 of the horizontal component 13 if an acute enough angle on the protected side is created as in FIG. 8. It is intended that each female member 16 be sufficiently shorter in length and sufficiently lower than it's corresponding male member 17 to accommodate enough vertical movement of one module with respect to an adjacent module that overlapping of the horizontal components 13 may be accommodated while maintaining attachment of the adjacent modules.

Figure 9:
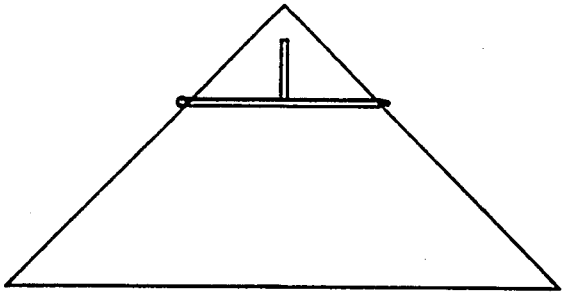
FIG. 9 shows a top view of a preferred embodiment of an alternative modular unit used to make a corner in the present barrier system.
Figure 10:
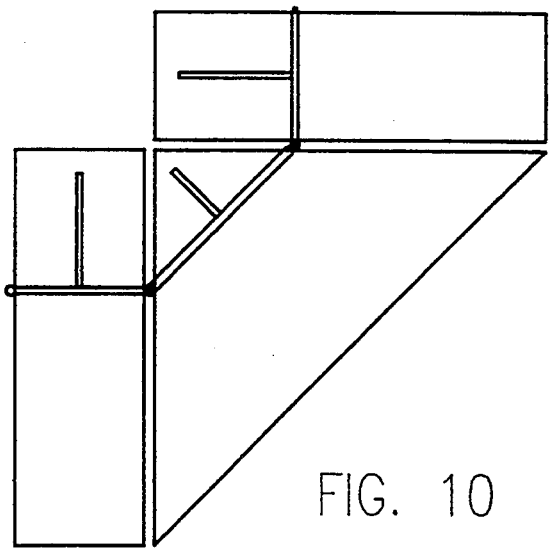
FIG. 10 shows a top view demonstrating the use of the modular unit of FIG. 9 in one possible arrangement in order to make a corner in the present barrier system.

In FIG. 8 the arrangement of the modules is such that the barrier system makes a 270° angle on the baby side of the barrier. It is apparent that this arrangement leaves a section of floor uncovered on the baby side of the barrier system thus allowing a child to push on the vertical component 14 of the barrier system while it is not fixed to the floor by the child's weight. It also requires that the diagonal brace 18 be removed from the module with the underlying horizontal component 13. An alternatively shaped module, the preferred embodiment being depicted from a top view in FIG. 9, would solve this problem. The components of this module are similar to those in the modular unit described in FIGS. 1 and 2, only the horizontal component of this module 22 is triangular in shape. The use of the alternatively shaped module of FIG. 9 is shown in FIG. 10 in which a 270° angle on the baby side of the barrier is made without significant exposed floor adjacent to the vertical components 14 of the barrier system.

Figure 11:
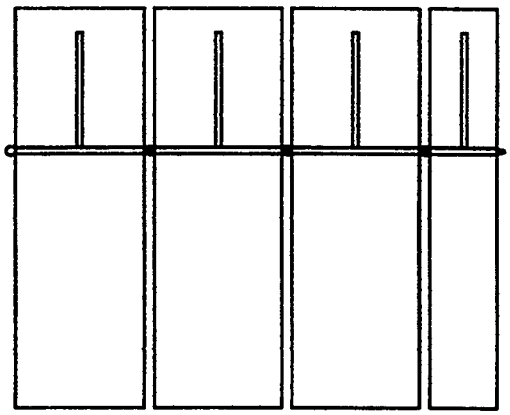
FIG. 11 shows a top view of the present barrier system demonstrating the linking of several modules in one possible arrangement in order to create a straight barrier and using a module of a different width in order to obtain a desired length of the barrier system.

FIG. 11 is a top view depicting how one or more of the modular units described in FIGS. 1 and 2 are varied in width to substantially increase the variety of lengths the barrier system is capable of attaining.

Although the above descriptions are of the preferred embodiment of the invention, it is not intended that these references be construed as limiting to the scope of this invention except as set forth in the following claims. This includes variation in the dimensions and shaped of the various components, variations in the materials used in construction of the invention, and variations in modes of attachment of the components of the invention.

I claim:

1. A free standing baby barrier system comprising:

modular units, wherein each of said modular units comprises a flat, substantially rigid mat-like horizontal component capable of lying on the floor, effecting a base of each of said modular units;

a flat, substantially rigid vertical component having a width comparable to said horizontal component and being attached at one end to near a mid-section of a top side of said horizontal component;

a means of attachment of said vertical component to said horizontal component;

a means of bracing said vertical component generally perpendicular to said horizontal component, said bracing means comprising a rigid, elongated diagonal brace between said vertical and said horizontal components and removably attached to said top side of said horizontal component and a side of said vertical component, said diagonal brace having flanges fixedly attached to ends thereof for being received into corresponding slotted mounds fixedly attached to said top side of said horizontal component and said side of said vertical component of each of said modular units; and a means of hingedly connecting said modular units one to another along a lateral edge of each said vertical component for rotation of said modular units relative to one another.

2. A means of bracing in a manually removable manner a vertical component of a portable barrier substantially perpendicular to a horizontal component to which one end of said vertical component is attached comprising:

a rigid, elongated substantially diagonal brace between said vertical and said horizontal components;

flanges fixedly attached to ends of said diagonal brace;

two mounds slotted for receiving said flanges, one mound being attached to a side of said vertical component, and the other mound being attached to a side of said horizontal component, said mounds being spaced from said attachment of said vertical component to said horizontal component, said flanges capable of being inserted horizontally into said slotted mounds for supporting said portable barrier.

* * * * *